US008813919B2

(12) United States Patent
Silberhorn et al.

(10) Patent No.: US 8,813,919 B2
(45) Date of Patent: Aug. 26, 2014

(54) ELEVATOR SAFETY SYSTEM PREVENTING COLLISION OF CARS

(75) Inventors: Gert Silberhorn, Merlischachen (CH); Hans Kocher, Udligenswil (CH); Steffen Grundmann, Bonstetten (CH)

(73) Assignee: Inventio AG, Hergiswil (CH)

( * ) Notice: Subject to any disclaimer, the term of this patent is extended or adjusted under 35 U.S.C. 154(b) by 583 days.

(21) Appl. No.: 13/141,813

(22) PCT Filed: Dec. 21, 2009

(86) PCT No.: PCT/EP2009/067640

§ 371 (c)(1), (2), (4) Date: Jun. 23, 2011

(87) PCT Pub. No.: WO2010/072714

PCT Pub. Date: Jul. 1, 2010

(65) Prior Publication Data

US 2011/0259674 A1 Oct. 27, 2011

(30) Foreign Application Priority Data

Dec. 23, 2008 (EP) ..... 08172707

(51) Int. Cl.
*B66B 1/34* (2006.01)

(52) U.S. Cl.
USPC ..... 187/391; 187/249

(58) Field of Classification Search
CPC ..... B66B 1/02; B66B 1/06; B66B 1/18; B66B 1/24; B66B 1/2433; B66B 1/2466; B66B 1/28
USPC ..... 187/247, 249, 380–388, 391–394
See application file for complete search history.

(56) References Cited

U.S. PATENT DOCUMENTS

| | | | | |
|---|---|---|---|---|
| 5,877,462 | A * | 3/1999 | Chenais | 187/249 |
| 6,273,217 | B1 * | 8/2001 | Hikita | 187/388 |
| 7,448,471 | B2 * | 11/2008 | Nuebling | 187/286 |
| 7,537,089 | B2 * | 5/2009 | Duenser et al. | 187/249 |
| 7,917,341 | B2 * | 3/2011 | Sansevero et al. | 703/1 |
| 7,980,362 | B2 * | 7/2011 | Kostka | 187/249 |
| 8,132,652 | B2 * | 3/2012 | Hakala et al. | 187/249 |
| 8,136,635 | B2 * | 3/2012 | Christy et al. | 187/249 |
| 8,230,977 | B2 * | 7/2012 | Thumm et al. | 187/247 |
| 8,307,952 | B2 * | 11/2012 | Fargo et al. | 187/257 |

FOREIGN PATENT DOCUMENTS

| | | | |
|---|---|---|---|
| EP | 1562848 | A1 | 8/2005 |
| EP | 1562848 | B1 | 1/2007 |
| EP | 1958909 | A1 | 8/2008 |
| WO | 2004043841 | A1 | 5/2004 |
| WO | 2007145613 | A2 | 12/2007 |

* cited by examiner

*Primary Examiner* — Anthony Salata
(74) *Attorney, Agent, or Firm* — Fraser Clemens Martin & Miller LLC; William J. Clemens

(57) ABSTRACT

An elevator installation includes a first elevator car and a second elevator car, each having a respective braking device, and a safety system that monitors the elevator cars. The safety system has for each braking device a braking force regulating device for regulating a braking force of the respective braking device. The safety system activates at least one of the braking devices by the associated braking force regulating device in order to prevent collision of the first elevator car with the second elevator car.

14 Claims, 2 Drawing Sheets

Fig. 1

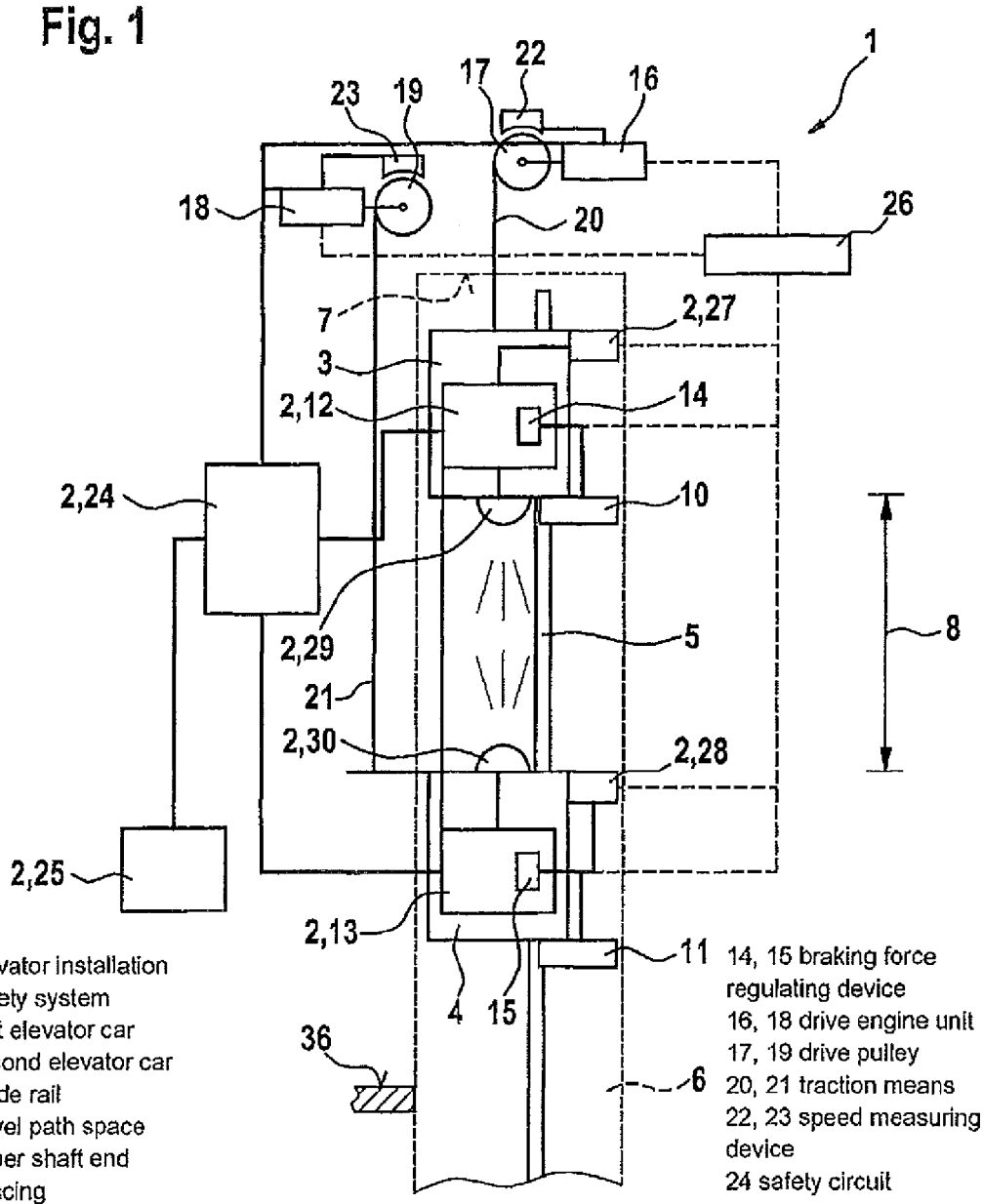

1 elevator installation
2 safety system
3 first elevator car
4 second elevator car
5 guide rail
6 travel path space
7 upper shaft end
8 spacing
10, 11 braking device
12,13 decentral safety device 14, 15 braking force regulating device
16, 18 drive engine unit
17, 19 drive pulley
20, 21 traction means
22, 23 speed measuring device
24 safety circuit
25 shaft monitoring unit
26 central control
27, 28 absolute sensor
29, 30 relative sensor
36 floor 1 elevator installation
2 safety system
3 first elevator car
4 second elevator car
5 guide rail
6 travel path space
7 upper shaft end
8 spacing
10, 11 braking device
14, 15 braking force regulating device
16, 18 drive engine unit 17, 19 drive pulley
20, 21 traction means
22, 23 speed measuring device
24 safety circuit
25 shaft monitoring unit
26 central control
27, 28 absolute sensor
35 central safety device
36 floor
37, 38 sensor

ELEVATOR SAFETY SYSTEM PREVENTING COLLISION OF CARS

FIELD OF THE INVENTION

The invention relates to an elevator installation with a first elevator car and at least one second car, which are arranged, for example, in a common elevator shaft and in operation cross this elevator shaft along a common travel path.

BACKGROUND OF THE INVENTION

An elevator installation with a shaft in which at least two cars are movable along a common travel path is known from DE 1 562 848 B1. In the known elevator installation the cars each comprise a safety brake device with which a control unit, a drive and a brake are associated. In addition, a shaft information system, which is connected with an electrical safety device, for determination of the positions and speeds of the cars is provided. In that case spacing sensors are provided which serve for determination of the spacing adopted by a specific car from an adjacent car or a travel path end and preferably also from a predetermined shaft point are provided, wherein the spacing sensors are connected with the safety device.

In order to trigger an emergency stop in a case of impermissible approach of two cars the triggering of at least one safety brake device is additionally provided, the triggering taking place mechanically. In the case of an intentional mutual approach of the two cars at very low speed, for example during an inspection or maintenance journey, however, no safety brake device is triggered. If, however, the cars have a higher speed then it is ensured by provision of a correspondingly high minimum spacing value that in the case of an impermissible approach a collision can be reliably prevented by triggering the respective safety brake device. The safety device can then comprise a determining unit which determines a speed-dependent minimum spacing.

The elevator installation known from EP 1 562 848 B1 has the disadvantage that large variations with respect to the braking travel arise, since the preset normal force generates, due to varying coefficients of friction, varying braking forces and these in turn produce different degrees of retardation depending on the respective load state of the respective car. At high car speeds these physical boundary conditions lead to very long stopping paths, since the braking travel increases at least approximately with the square of car speed.

SUMMARY OF THE INVENTION

It is an object of the invention to create an elevator installation in which an optimized operation is made possible. Specifically, it is an object of the invention to create an elevator installation in which the braking actions of braking devices for the elevator cars are optimized.

It is advantageous that a measuring device for the first elevator car is provided, which device serves for at least indirect detection of retardation of the first elevator car, that a measuring device for the second elevator car is provided, which device serves for at least indirect detection of retardation of the elevator car, and that the safety system determines a target retardation value for the braking force regulating device of the braking device of the first elevator car and a target retardation value for the braking force regulating device of the braking device of the second elevator car. The safety system has at least one processor for calculation of the target retardation values and for drive control of the braking devices.

An optimized stopping of the elevator cars can be effected by the determination of target retardation values. Specifically, a desired retardation of an elevator car with respect to different load states can be achieved. Variations of the desired braking travel can thereby be reduced. Specifically, an optimized operation is possible, since by contrast to a combination of predetermined normal force and minimum spacing, which has to be oriented towards the least favorable case, an advantageous adaptation to the instantaneous operational state is possible. Specifically, unnecessarily high levels of retardation of an elevator car, which can lead to falling over and injury of persons in the elevator car, can be avoided.

In that case it is additionally advantageous if the safety system in an operational state in which the elevator cars cross their travel path spaces in the same direction along their travel paths determines for the braking force regulating device of the braking device of that elevator car which is a trailing car in this operational state a larger target retardation value than for the braking force regulating device of the braking device of that elevator car which in this operational state is a leading elevator car. Reliable stopping of the two elevator cars is thereby made possible, wherein the trailing elevator car can be stopped with a greater level of retardation and/or stopping of the elevator cars with a reduced minimum spacing is triggered, collision of the two elevator cars thus being reliably prevented.

In that case it is also advantageous if the safety system in an operational state in which at least one elevator car crosses its travel path space along its travel path in upward direction so determines the target retardation value for the braking force regulating device of the braking device of the elevator car crossing its travel path space along its travel path in upward direction that the target retardation value is below gravitational acceleration. Specifically, the target retardation value is in this connection selected to be significantly smaller than gravitational acceleration. Lifting of passengers or of objects conveyed in the elevator car during the deceleration can thereby be prevented.

In that case it is further of advantage if the measuring devices are designed as speed measuring devices which detect a speed of the elevator cars and that the speed measuring devices determine the retardations of the elevator cars from a change in the speeds of the elevator cars. An indirect determination of the retardations of the elevator cars is thereby possible. In that case it is further advantageous that the speed measuring devices are arranged at drive pulleys of the drive engine units for the elevator cars. A compact design of the elevator installation is thereby possible, wherein the speed measuring devices can in a given case also be used for further operating functions of the elevator installation or are required for that purpose anyway. The speed measuring devices can, however, also be provided at deflecting rollers or designed as separate devices which are independent of the drives of the elevator installation.

In advantageous manner the safety system comprises an absolute sensor which is provided at the first and which serves for detection of a position of the first elevator car in the travel path space which the first elevator car crosses along its travel path. Similarly, the safety system comprises an absolute sensor which is provided at the second elevator car and which serves for detection of a position of the second elevator car in the travel path space which the second elevator car crosses along its travel path. In that case the safety system determines a spacing between the first elevator car and the second elevator car in dependence on the position, which is detected by the absolute sensor provided at the first elevator car, of the first elevator car and the position, which is detected by the absolute sensor provided at the second elevator car, of the second elevator car. In addition, the safety system, for preventing collision of the first elevator car with the second elevator car, activates the braking device of the first elevator car and/or the braking device of the second elevator car in dependence on the spacing between the first elevator car and the second elevator car. The spacing between the elevator cars can thus be ascertained from the positions detected by the absolute sensors. In this connection, a spacing from the respective end of a travel path or of a travel path space can also be determined. A reliable operation for prevention of a collision can thus be guaranteed. The safety system can in that case be designed to be central or decentral.

By a decentrally designed safety system there is to be understood a safety system which comprises individual safety devices, wherein each safety device is positioned on an elevator car and preferably also monitors this elevator car. Thereagainst, a central safety system possesses a safety device which monitors all elevator cars.

Moreover, it is advantageous that the safety system comprises a decentral safety device, which is provided at the first elevator car and which activates the braking device of the first car in dependence on the spacing between the first elevator car and the second elevator car as determined in dependence on the positions of the elevator cars, and a safety device, which is provided at the second elevator car and which activates the braking device of the second elevator car in dependence on the spacing between the first elevator car and the second elevator car as determined in dependence on the positions of the elevator cars. A decentral design of the safety system can thereby be realized. The decentral safety devices can in that case be provided at the elevator cars as independent monitoring units. This has the advantage that it is not necessary to provide secure connections to the safety circuit of the safety system from each elevator car to the outside. The activation of the braking device by the safety device provided at the elevator car is in this connection simplified with respect to the required secure connection. In such a decentral arrangement of the safety system each safety device has at least a processor for calculation of the target retardation values and for activating the braking devices.

However, it is also advantageous that the safety system has a central safety device which activates the braking device of the first elevator car by means of the brake regulating device provided at the first elevator car and the braking device of the second elevator car by means of the brake regulating device provided at the second elevator car in dependence on the spacing between the first elevator car and the second elevator car as determined in dependence on the positions of the elevator cars. A centrally designed safety system can thereby realized. In this connection the central safety device can serve as a monitoring unit. In that case, secure transmission channels for the positions and/or speed signals of the two elevator cars to the central safety device are in a given case required. Through the central safety device the outlay on control can in a given case be reduced and evaluation and consideration of different items of information simplified.

Data cables, data buses or also cable-free data transmission means, such as radio connections, Wireless LAN or the like preferably serve as transmission channels. A secure transmission of data by way of the transmission channels can be achieved, for example, by a redundant design of the transmission channels, by data transmission protocols, or by polling of the sensors—which communicate positions and/or speed signals—by the central safety device 35 via a data bus.

It is advantageous if the safety system comprises a relative sensor which is provided at the first elevator car and serves for detection of a spacing between the first elevator car and the second elevator car. Alternatively or in addition thereto the safety system comprises a relative sensor which is provided at the second elevator car and serves for detection of a spacing between the first elevator car and the second elevator car. Finally, for preventing a collision between the first elevator car and the second elevator car the safety system drive activates the braking device of the first elevator car and/or the braking device of the second elevator car in dependence on the detected spacing between the first elevator car and the second elevator car. In this connection it is additionally advantageous that the safety system comprises a decentral safety device, which is provided at the first elevator car and which activates the braking device of the first elevator car in dependence on the spacing detected by the relative sensor provided at the first elevator car, and a decentral safety device, which is provided at the second elevator car and which activates the braking device of the second elevator car in dependence on the spacing detected by the relative sensor provided at the second elevator car. The relative sensors can in that case advantageously be combined with absolute sensors. An individual spacing detection can be performed at each elevator car by the relative sensors in order to make possible a high level of operational safety. In this connection, the data detected by the relative sensor can advantageously be evaluated at the respective elevator car so that a reliable activation of the respective braking device is achieved and can be realized with relatively low outlay.

In advantageous manner the braking device of at least one elevator car has the function of an emergency stopping brake, which is actuable by the safety system by means of the brake regulating device for preventing a collision between the first elevator car and the second elevator car, and the function of a stopping and/or safety brake. It is thereby possible to dispense with a separate stopping or safety brake.

In advantageous manner the braking device of at least one elevator car comprises a regulable brake actuator which enables a selective build up of braking force. In this connection it is additionally advantageous if the safety system in an operational state in which an emergency stop of the elevator car is carried out so activates the brake actuator of the braking device of at least one elevator car that through a regulated release and application of the braking device the elevator car is movable to a desired evacuation position in its travel path space along its travel path. A selective release and application of the brake actuators can thus be carried out for evacuation of the passengers so as to move one or both elevator cars selectively up or down dependent on load and to bring it or them to a desired destination, i.e. the evacuation position. In a given case a selective approach of the two elevator cars is also possible in order to couple these together.

However, it is also advantageous if at least one elevator car has a separate safety brake and if the safety system in the case of triggering of the safety brake of the elevator car additionally activates the braking device. In this additional activation of the braking device, starting from an insignificant additional braking force a selective supporting of the braking force of the safety brake can be carried out in order to also reliably avoid, in dependence on the respective spacing of the elevator cars, an approach collision in this situation. The triggering of the safety brake can be carried out, for example, in the case of breakage of support means.

DESCRIPTION OF THE DRAWINGS

Preferred exemplifying embodiments of the invention are explained in more detail in the following description by way of the accompanying drawings, in which corresponding elements are provided with corresponding reference numerals and in which:

FIG. 1 shows an elevator installation with a safety system in a schematic illustration in correspondence with a first exemplifying embodiment of the invention.

DETAILED DESCRIPTION OF THE INVENTION

Figure 2:
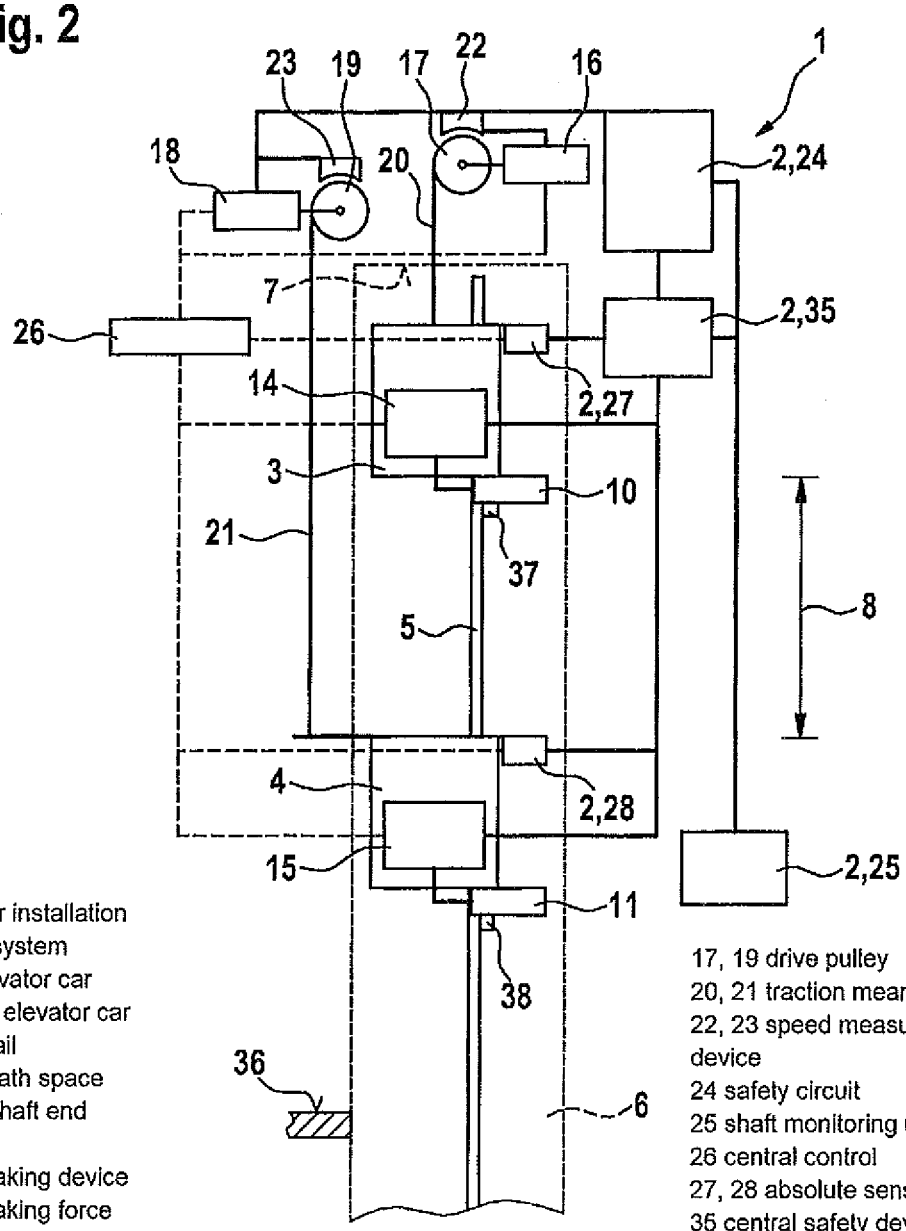
FIG. 2 shows the elevator installation, which is illustrated in FIG. 1, in correspondence with a second exemplifying embodiment of the invention.

FIG. 1 shows an elevator installation with a safety system 2 in a schematic illustration in correspondence with a first exemplifying embodiment. The elevator installation 1 of this exemplifying embodiment comprises a first elevator car 3 and a second elevator car 4. Depending on the respective design of the elevator installation 1, however, also more than two elevator cars 3, 4 can be provided. The elevator cars 3, 4 are guided at a common guide rail 5 which predetermines a travel path 5 for the elevator cars 3, 4.

The elevator cars 3, 4 during their journey along the guide rails 5 cross a travel path space 6 which is illustrated as a section in FIG. 1. The travel space 6 in this exemplifying embodiment is crossed by two elevator cars 3, 4. However, a position at the upper shaft end 7 is reachable only by the elevator car 3, whilst a corresponding position at a lower shaft end (not illustrated) is reachable only by the second elevator car 4.

In operation the first elevator car 3 is always disposed above the second elevator car 4, wherein a spacing 8 between the elevator cars 3, 4 can vary substantially as desired. It is also possible for an individual travel path space to be provided for each elevator car 3, 4, which spaces are only partly congruent, for example, the second elevator car 4 can travel to the floors "−1" to "10", whilst the first elevator car 3 travels to the floors "8" to "14". The travel path space for the first elevator car 3 and the travel path space for the second elevator car 4 are coincident in such a case only with respect to the floors "8" to "10".

A braking device 10 which co-operates with the guide rails 5 is provided at the first elevator car 3. In addition, a braking device 11 which similarly co-operates with the guide rails 5 is arranged at the second elevator car 4. In this exemplifying embodiment the safety system 2 comprises a decentral safety device 12 provided at the first elevator car 3 and a decentral safety device 13 provided at the second elevator car 4. The decentral safety device 12 of the first elevator car 3 comprises a braking force regulating device 14 serving for regulation of a braking force of the braking device 10. Correspondingly, the decentral safety device 13 of the second elevator car 4 comprises a braking force regulating device 15 serving for regulation of the braking force of the braking device 11.

The elevator installation 1 comprises a drive engine unit 16 and a drive pulley 17, which is driven by the drive unit 16, for the first elevator car 3. In addition, the elevator installation 1 comprises a drive engine unit 18 and a drive pulley 19, which is driven by the drive engine unit 18, for the second elevator car 4. The actuation of the elevator cars 3, 4 by means of the drive engine units 16, 18 is carried out by way of traction means 20, 21 guided over the drive pulleys 17, 19. In addition, counterweights, which for the sake of simplification of the illustration are not illustrated, for the elevator cars 3, 4 are provided.

A speed measuring device 22 is arranged at the drive pulley 17. In addition, a speed measuring device 23 is arranged at the drive pulley 19. The speed measuring device 22 ascertains, for example by way of pulse transmitters mounted at the drive pulley 17, a rotational speed of the drive pulley 17. In that case the speed measuring device 22 can detect a speed of the first elevator car 3 during its journey along the guide rails 5. Correspondingly, the speed measuring device 23 detects a speed of the second elevator car 4.

Moreover, the measuring devices 22, 23 are designed to determine accelerations and decelerations of the elevator cars 3, 4 from the detected speed data. The data detected by the speed measuring devices 22, 23 are output at a safety circuit 24 of the safety system 2. The safety circuit 24 can be formed by, for example, a data bus. Apart from the speed measuring devices 22, 23 the decentral safety devices 12, 13 and a shaft monitoring unit 25 are also connected with the safety circuit 24. In that case suitable interfaces with respect to the safety circuit 24 are provided. The shaft monitoring unit 25 can, for example, determine an operational state of the elevator installation 1 and communicate this to the decentral safety devices 12, 13. A data processing of the safety system 2 can thereby be carried out part in the shaft monitoring unit 25.

The elevator installation 1 further comprises a central control 26 which controls the drive engine unit 16, 18 in drive. The central control 26 in that case executes control commands for the normal operation of the elevator installation 1, for example in order to move one of the elevator cars 3, 4 to a desired floor.

In this exemplifying embodiment the safety system 2 comprises an absolute sensor 27 which is provided at the first elevator car 3 and serves for detecting a position of the first elevator car 3 in the travel path space 6 and an absolute sensor 28 which is provided at the second elevator car 4 and serves for detecting a position of the second elevator car 4 in the travel path space 6. In this connection the absolute sensors 27, 28 can detect the positions of the elevator cars 3, 4 at the guide rail 5.

The absolute positions, which are detected by the absolute sensors 27, 28, of the elevator cars 3, 4 are on the one hand communicated to the central control 26 for performance of the usual operation of the elevator installation 1. On the other hand, the absolute positions of the elevator cars 3, 4 are output at the decentral devices 12, 13 of the safety system 2.

The safety system 2 determines from these absolute positions of the elevator cars 3, 4 the spacing 8 between the first car 3 and the second car 4.

This determination can, for example, be performed in the shaft monitoring unit 25. Depending on the instantaneous spacing 8 between the elevator cars 3, 4 activation of the braking force regulating devices 14, 15 takes place in order to prevent collision of the elevator cars 3, 4 during their travel through the travel path space 6. If the spacing 8 between the elevator cars 3, 4 with respect to the instantaneous operational state of the elevator installation 1 falls below a critical value then the safety system 2 activates the braking devices 10, 11 of the elevator cars 3, 4 by means of the braking force regulating devices 14, 15. If, for example, the two elevator cars 3, 4 move downwardly and the spacing 8 reaches or falls below a critical spacing then actuation of the braking devices 10, 11 is carried out.

In such an actuation of braking devices 10, 11 the safety system 2, particularly the shaft monitoring unit 25, presets individual target retardation values for the braking force regulating devices 14, 15. In this case a greater target retardation value is preset for the braking force regulating device 14 than for the braking force regulating device 15. A stronger deceleration of the first elevator car 3 is thereby achieved. The second elevator car 4, thereagainst, is less strongly decelerated. The regulation of the decelerations of the elevator cars 3, 4 can be carried out, for example, by comparison of the actual retardations, which are determined by the speed measuring devices 22, 23, with respect to the target retardation values for the braking force regulating devices 14, 15.

For determination of the respective retardation of the elevator cars 3, 4, however, there can also be reliance on the data made available by the absolute sensors 27, 28. Moreover, suitable sensors which directly measure an acceleration or a deceleration can also be provided at the elevator cars 3, 4.

In another possible operating state in which the two elevator cars 3, 4 move upwardly, a retardation of the elevator cars 3, 4 by the braking devices 10, 11 by means of the braking force regulating devices 14, 15 is similarly achieved if the spacing 8 falls below a critical distance. In this case, however, the target retardation values are determined to be smaller and preferably substantially smaller than gravitational acceleration. As a result, lifting up of persons who or objects which are transported in the elevator cars 3, 4 is prevented.

Correspondingly, a specific maximum target retardation value can also be preset for the target retardation values in the case of downward travel. The presetting of such maximum target retardation values is taken into consideration in the determination of the critical distance for the spacing 8 between the elevator cars 3, 4 by the safety system 2, particularly the shaft monitoring unit 25.

The shaft monitoring unit 25 can in that case determine the critical distance for the spacing 8 between the elevator cars 3, 4 in dependence on the instantaneous operational state. This means that the critical distance for the spacing 8 can change depending on the respective operational state of the elevator installation 1.

The safety system 2 moreover comprises a relative sensor 29 provided at the first elevator car 3 and a relative sensor 30 provided at the second elevator car 4. The relative sensors 29, 30 each serve for detection of the spacing 8 between the first elevator car 3 and the second elevator car 4. The relative sensor 29 is connected with the decentral safety device 12 of the first elevator car 3. In addition, the relative sensor 30 is connected with the decentral safety device 13 of the second elevator car 4.

The respective spacing 8 detected by the relative sensors 29, 30 can, together with further data made available by the shaft monitoring unit 25, provide a basis in the decentral safety devices 12, 13 for the decision whether stopping of the elevator cars 3, 4 is required for prevention of a collision between the elevator cars 3, 4. Through the relative sensors 29, 30 a further possibility of detecting the spacing 8 between the elevator cars 3, 4 thus exists. Moreover, the relative sensors 29, 30 in combination with the absolute sensors 27, 28 serve for detection of the spacing 8. A redundancy for increasing the operational safety can thereby be created.

FIG. 2 shows an elevator installation 1 in a schematic illustration in correspondence with a second exemplifying embodiment. In this exemplifying embodiment, by contrast to the first exemplifying embodiment described with reference to FIG. 1, only absolute sensors 27, 28 are provided at the elevator cars 3, 4. In addition, only braking force regulating devices 14, 15 are provided at the elevator cars 3, 4, whereas in the case of the first exemplifying embodiment described with reference to FIG. 1 decentral safety devices 12, 13 with such braking force regulating devices 14, are provided at the elevator cars 3, 4. Instead of the decentral safety devices 12, 13 at the elevator cars 3, 4 a central safety device 35 of the safety system 2 is provided for the second exemplifying embodiment described with reference to FIG. 2.

The central safety device 35 of the safety system 2 is connected with the other components of the safety system 2 by way of the safety circuit 24. In particular, the central safety device 35 is connected with the absolute sensors 27, 28 of the elevator cars 3, 4, the braking force regulating devices 14, 15 of the elevator cars 3, 4, the shaft monitoring unit 25 and the speed measuring devices 22, 23. In this case secure transmission channels between the speed measuring devices 22, 23 and the central safety device 35 as well as between the absolute sensors 27, 28 and the central safety device 35 are provided.

In a case in which the elevator cars 3, 4 are to be stopped for prevention of a collision the central safety device 35 activates the braking devices 10, 11 by means of the respective braking force regulating device 14, 15. The central safety device 35 thus takes over the functions of the decentral safety devices 12, 13, which are described with reference to FIG. 1, of the elevator installation 1 of the first exemplifying embodiment.

In the described exemplifying embodiments the braking devices 10, 11 each have a respective regulable brake actuator which enables a selective build up of braking force. In this connection it is possible that the braking devices 10, 11 also have, apart from the function of an emergency stopping brake which is actuable by the safety system 2 by means of the braking force regulating devices 14, 15 for prevention of a collision between the elevator cars 3, 4, the function of a stopping and/or safety brake.

On the other hand, it is also possible for a separate stopping brake and/or a separate safety brake to be provided, wherein in this case a support of the braking action of a stopping and/or safety brake is possible by the braking devices 10, 11.

The braking devices 10, 11 can, in addition, comprise a brake actuator. The safety system 2 can so activate the braking devices 10, 11 that, through a regulated release and application of the braking devices 10, 11 of the elevator cars 3, 4, the elevator cars 3, 4 are moved to a desired evacuation position in the travel path space 6. For example, a floor 36 can be selected as desired evacuation position 36 to which the second elevator car 4 is moved so as to enable evacuation.

In the described exemplifying embodiments the braking devices 10, 11 are arranged in a lower region of the elevator cars 3, 4. However, it is also advantageous to arrange the braking devices 10, 11 at an upper region of the elevator cars 3, 4. The braking devices 10, 11 can be designed as electromechanical or hydraulic braking devices. In addition, the braking devices 10, 11 can comprise a brake actuator for defined build up of braking force.

Moreover, sensors 37, 38 (FIG. 2) serving for measuring the braking forces, the normal forces and/or a retardation of the respective elevator car 3, 4 can be provided at the braking devices 10, 11. These sensors 37, 38 are preferably connected with the braking force regulating devices 14, 15 and/or with the central safety device 35 or the decentral devices 12, 13. The target retardation values for the braking force regulating devices 14, 15 can respectively depend on several parameters, particularly the operating state and/or load state of the elevator installation 1 and the elevator cars 3, 4. Specifically, the target retardation values can be determined in dependence on position, speed and/or retardation.

The elevator installation 1 in the exemplifying embodiments is equipped with two elevator cars 3, 4. In corresponding manner, however, also more than two elevator cars 3, 4 can be provided. The elevator cars 3, 4 can in that case substantially cross a common travel path space 6. However, it is also possible for several travel path spaces to be provided, which are partly congruent.

The measuring devices 22, 23 for speed measurement for the elevator cars 3, 4 can also be realized in other ways. Specifically, the measuring devices 22, 23 can be provided at the elevator cars 3, 4, for example in the form of the sensors 37, 38. Moreover, the absolute sensors 27, 28 can also be utilized for speed measurement so that the absolute sensors 27, 28 also take over the function of the measuring devices 22, 23.

The invention is not restricted to the described exemplifying embodiments.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation having a first elevator car and at least a second elevator car, wherein a first travel path space crossable by the first elevator car along a travel path thereof and a second travel path space crossable by the second elevator car along a travel path thereof are at least partly coincident, wherein the first elevator car is provided with a first braking device, wherein the second elevator car is provided with a second braking device, and including a safety system for preventing collision of the first elevator car with the second elevator car, comprising:

the safety system including a first braking force regulating device for the first braking device of the first elevator car, the first regulating device regulating a braking force of the first braking device;

the safety system including a second braking force regulating device for the second braking device of the second elevator car, the second regulating device regulating a braking force of the second braking device, and wherein the safety system for preventing collision of the first elevator car with the second elevator car activates at least one of the first braking device of the first elevator car with the first braking force regulating device and the second braking device of the second elevator car with the second braking force regulating device to prevent a collision of the first and second elevator cars;

the safety system including a first measuring device associated with the first elevator car, the first measuring device detecting a retardation of the first elevator car, a second measuring device associated with the second elevator car, the second measuring device detecting a retardation of the second elevator car, and wherein the safety system determines a first target retardation value for the first braking force regulating device and a second target retardation value for the second braking force regulating device; and wherein the safety system, in an operational state in which the first and second elevator cars cross the first and second travel path spaces respectively in a same direction with the first elevator car trailing the second elevator car, determines for the first braking force regulating device the first target retardation value with a greater value than a value of the second target retardation value for the second braking force regulating device.

2. The elevator installation according to claim 1 wherein the safety system, in an operational state in which at least one of the first and second elevator cars crosses in an upward direction the respective one of the first and second travel path spaces, determines the respective one of the first and second target retardation values to be less than gravitational acceleration.

3. The elevator installation according to claim 1 wherein at least one of the first and second measuring devices is a speed measuring device which detects a speed of the associated one of the first and second elevator cars, and the speed measuring device also determines a retardation of the associated one of the first and second elevator cars from a change in a speed of the associated one of the first and second elevator cars.

4. The elevator installation according to claim 3 wherein the speed measuring device is one of arranged at a drive pulley of a drive engine unit for the associated one of the first and second elevator cars and provided at the associated one of the first and second elevator cars.

5. The elevator installation according to claim 1 wherein the safety system includes a first absolute sensor at the first elevator car that detects a position of the first elevator car in the first travel path space, and a second absolute sensor at the second elevator car that detects a position of the second elevator car in the second travel path space, the safety system determining a spacing between the first elevator car and the second elevator car in dependence on the detected position of the first elevator car detected by the first absolute sensor and on the detected position of the second elevator car detected by the second absolute sensor, and wherein the safety system prevents collision of the first elevator car with the second elevator car by activating at least one of the first braking device and the second braking device in dependence on the determined spacing between the first elevator car and the second elevator car.

6. The elevator installation according to claim 5 wherein the safety system includes a first decentral safety device provided at the first elevator car for activating the first braking device of the first elevator car in dependence on the determined spacing between the first elevator car and the second elevator car as determined in dependence on the determined positions of the first and second elevator cars, and a second decentral safety device provided at the second elevator car for activating the second braking device of the second elevator car in dependence on the determined spacing between the first elevator car and the second elevator car as determined in dependence on the determined positions of the first and second elevator cars.

7. The elevator installation according to claim 5 wherein the safety system includes a central safety device that in dependence on the determined spacing between the first elevator car and the second elevator car as determined in dependence on the determined positions of the first and second elevator cars activates the first braking device of the first elevator car by the first braking force regulating device and the second braking device of the second elevator car by the second braking force regulating device.

8. The elevator installation according to claim 1 wherein the safety system includes a first relative sensor provided at the first elevator car that detects a first spacing between the first elevator car and the second elevator car, and a second relative sensor provided at the second elevator car that detects a second spacing between the first elevator car and the second elevator car, and where the safety system for preventing collision between the first elevator car and the second elevator car activates at least one of the first braking device and the second braking device in dependence on the detected first and second spacings respectively.

9. The elevator installation according to claim 8 wherein the safety system includes a first decentral safety device provided at the first elevator car and activates the first braking device in dependence on the detected first spacing, and a second decentral safety device provided at the second elevator car and activates the second braking device in dependence on the detected second spacing.

10. The elevator installation according to claim 9 wherein the first braking device functions as an emergency stopping brake that is actuable by the safety system by the first braking force regulating device for preventing collision between the first elevator car and the second elevator car and also functions as a stopping or safety brake.

11. The elevator installation according to claim 1 wherein the safety system, in an operational state in which an emergency stop of the first and second elevator cars is performed, activates at least one of the first and second braking devices whereby associated one of the first and second elevator cars is movable to a desired evacuation position in the associated one of the first and second travel path spaces by a regulated releasing and applying of the one of the first and second braking devices.

12. An elevator installation having a first elevator car and at least a second elevator car, wherein a first travel path space crossable by the first elevator car along a travel path thereof and a second travel path space crossable by the second elevator car along a travel path thereof are at least partly coincident, wherein the first elevator car is provided with a first braking device, wherein the second elevator car is provided with a second braking device, and including a safety system for preventing collision of the first elevator car with the second elevator car, comprising:

the safety system including a first braking force regulating device for the first braking device of the first elevator car, the first regulating device regulating a braking force of the first braking device;

the safety system including a second braking force regulating device for the second braking device of the second elevator car, the second regulating device regulating a braking force of the second braking device, and wherein the safety system for preventing collision of the first elevator car with the second elevator car activates at least one of the first braking device of the first elevator car with the first braking force regulating device and the second braking device of the second elevator car with the second braking force regulating device to prevent a collision of the first and second elevator cars;

the safety system including a first measuring device associated with the first elevator car, the first measuring device detecting a retardation of the first elevator car, a second measuring device associated with the second elevator car, the second measuring device detecting a retardation of the second elevator car, and wherein the safety system determines a first target retardation value for the first braking force regulating device and a second target retardation value for the second braking force regulating device; and wherein the safety system, in an operational state in which at least one of the first and second elevator cars crosses in an upward direction the respective one of the first and second travel path spaces, determines the respective one of the first and second target retardation values to be less than gravitational acceleration.

13. An elevator installation having a first elevator car and at least a second elevator car, wherein a first travel path space crossable by the first elevator car along a travel path thereof and a second travel path space crossable by the second elevator car along a travel path thereof are at least partly coincident, wherein the first elevator car is provided with a first braking device, wherein the second elevator car is provided with a second braking device, and including a safety system for preventing collision of the first elevator car with the second elevator car, comprising:

the safety system including a first braking force regulating device for the first braking device of the first elevator car, the first regulating device regulating a braking force of the first braking device; and the safety system including a second braking force regulating device for the second braking device of the second elevator car, the second regulating device regulating a braking force of the second braking device, and wherein the safety system for preventing collision of the first elevator car with the second elevator car activates at least one of the first braking device of the first elevator car with the first braking force regulating device and the second braking device of the second elevator car with the second braking force regulating device to prevent a collision of the first and second elevator cars;

the safety system including a first measuring device associated with the first elevator car, the first measuring device detecting a retardation of the first elevator car, a second measuring device associated with the second elevator car, the second measuring device detecting a retardation of the second elevator car, and wherein the safety system determines a first target retardation value for the first braking force regulating device and a second target retardation value for the second braking force regulating device; and wherein at least one of the first and second measuring devices is a speed measuring device which detects a speed of the associated one of the first and second elevator cars, and the speed measuring device also determines a retardation of the associated one of the first and second elevator cars from a change in a speed of the associated one of the first and second elevator cars.

14. The elevator installation according to claim 13 wherein the speed measuring device is one of arranged at a drive pulley of a drive engine unit for the associated one of the first and second elevator cars and provided at the associated one of the first and second elevator cars.

* * * * *